US006161736A

United States Patent [19]

Kaufman et al.

[11] Patent Number: 6,161,736

[45] Date of Patent: Dec. 19, 2000

[54] DISPENSER APPARATUS

[75] Inventors: Brett Kaufman, Newburgh; David Jochem, Evansville, both of Ind.

[73] Assignee: Berry Plastics Corporation, Evansville, Ind.

[21] Appl. No.: 09/354,618

[22] Filed: Jul. 16, 1999

Related U.S. Application Data

[60] Provisional application No. 60/093,130, Jul. 16, 1998.

[51] Int. Cl.[7] ..... B65D 83/00

[52] U.S. Cl. ..... 222/402.13; 222/402.15

[58] Field of Search ..... 222/108, 153.05, 222/402.13, 402.15

[56] References Cited

U.S. PATENT DOCUMENTS

| | | |
|---|---|---|
| 3,223,287 | 12/1965 | Sagarin . |
| 3,225,966 | 12/1965 | Sagarin . |
| 3,240,397 | 3/1966 | Sagarin . |
| 3,260,416 | 7/1966 | Abplanalp . |
| 3,373,908 | 3/1968 | Crowell . |
| 3,494,510 | 2/1970 | Rahn . |
| 3,540,624 | 11/1970 | Green ..... 222/108 |
| 3,651,993 | 3/1972 | Venus, Jr. . |
| 3,722,748 | 3/1973 | Wakeman et al. . |
| 3,738,537 | 6/1973 | Gach . |
| 3,744,682 | 7/1973 | Blank . |
| 3,913,805 | 10/1975 | Sette . |
| 4,482,082 | 11/1984 | Goncalves . |
| 4,506,808 | 3/1985 | Goncalves . |
| 4,513,890 | 4/1985 | Goncalves . |
| 5,379,924 | 1/1995 | Taylor . |
| 6,006,957 | 12/1999 | Kunesh . |

FOREIGN PATENT DOCUMENTS

| | | |
|---|---|---|
| 17 75 477 | 8/1968 | Austria . |
| 1 390 223 | 6/1972 | United Kingdom . |
| 1 493 032 | 2/1975 | United Kingdom . |
| 1 507 784 | 4/1976 | United Kingdom . |
| 1 512 869 | 11/1976 | United Kingdom . |
| 2 023 745 | 1/1980 | United Kingdom . |
| WO98/28207 | 7/1998 | WIPO . |

*Primary Examiner*—Kevin Shaver
*Assistant Examiner*—David Deal
*Attorney, Agent, or Firm*—Barnes & Thornburg

[57] ABSTRACT

A dispenser apparatus, including a can formed with an interior region to store pressurized fluid therein and a discharge valve coupled to the can. The discharge valve is able to move relative to the can in order to discharge pressurized fluid from the interior region of the can. A button is positioned to engage and move the discharge valve relative to the can to discharge pressurized fluid from the interior region of the can. A cap, including a shell coupled to the can and a button support coupled to the shell, is formed to include a chamber having walls that receives the button therein. The button is supported in a spaced-apart relation from the discharge valve during coupling of the shell to the can to maintain the button in a position disengaged from the discharge valve until a first engagement of the button and the discharge valve to discharge pressurized fluid from the interior region of the can, thereby preventing accidental release of can contents, known as huffing, when the cap is coupled onto the can.

33 Claims, 4 Drawing Sheets

DISPENSER APPARATUS

This application claims priority under U.S.C. 0 119(e) to U.S. Provisional application Ser. No. 60/093,130, filed Jul. 16, 1998, which is expressly incorporated by reference herein.

BACKGROUND AND SUMMARY OF THE INVENTION

The present invention relates to a dispenser apparatus including an aerosol spray can, and particularly to a cap adapted to actuate a discharge valve coupled to the aerosol spray can. More particularly, the present invention relates to a dispenser apparatus including a cap and a push-button mounted in the cap and arranged to actuate the discharge valve coupled to an aerosol spray can.

During the assembly of aerosol spray cans, a push button typically is mounted on a discharge valve coupled to a pressurizable container and adapted to be actuated by the movement of the push-button relative to the container. Next, a cap is mounted on the aerosol spray can so that the push-button already mounted on the discharge valve is received within and coupled to the cap. Often times, during this process, the discharge valve will be activated inadvertently when the push-button is mounted on the discharge valve or when the cap is placed over the push-button and mounted on the aerosol spray can. This will cause some of the contents from within the aerosol spray can to be discharged through the discharge valve to the surroundings during installation of the cap on the aerosol spray can. This inadvertent discharge during cap installation is called "huffing".

In accordance with the present invention, a dispenser apparatus includes a can, a discharge valve coupled to the can and configured to discharge pressurized fluid in the can, and a cap coupled to the can. The dispenser apparatus further includes a button adapted to be coupled to the discharge valve. The cap is configured to support the button initially in a predetermined position above the discharge valve until a user moves the button relative to the can to actuate the discharge valve for the very first time.

In preferred embodiments, the cap includes a shell adapted to mount on a can, an actuator lever pivotably coupled to the shell, and a button mount coupled to the actuator lever to move them with. The push-button is pre-installed within the button mount included in the cap prior to installation of the cap on the aerosol spray can. Once the cap is mounted on the can, the push-button is positioned to lie above and in spaced-apart relation to a discharge valve coupled to the can so as to minimize the opportunity for inadvertent premature fluid discharge or huffing during cap installation. The push-button is moved to couple to and actuate the discharge valve only when a user later moves the actuator lever for the first time to engage the pushbutton to the underlying discharge valve to discharge pressurized aerosol spray from the can through the discharge valve.

In preferred embodiments, A dispenser apparatus comprising

- a can formed to include an interior region to store pressurized fluid therein,
- a discharge valve coupled to the can and configured to discharge pressurized fluid from the interior region of the can, and
- a cap coupled to the can, the cap including a shell arranged to cooperate with the can to define a space therebetween receiving the discharge valve therein, a button adapted to be coupled to the discharge valve and to be moved relative to the can to actuate the discharge valve to discharge pressurized fluid from the interior region of the can, a button mount coupled to the button, and means for supporting the button mount above the can to position the button in a predetermined position above and in spaced-apart relation to the discharge valve so that movement of the button mount toward the can engages the button to the discharge valve to actuate the discharge valve, the support means including a lever coupled to the shell.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
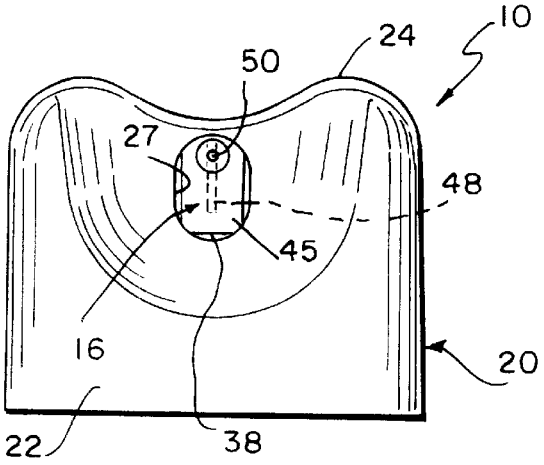
FIG. 1 is a front elevation view of a lid in accordance with the present invention for mounting on an aerosol spray can showing the lid including a cap adapted to mount on the aerosol spray can and a push-button coupled to the cap for movement relative to the cap.

A lid 10 (or cap and push-button subassembly) for mounting on a can 12 and a push-button 16 coupled to cap 14 as shown in FIG. 1. In a preferred embodiment, can 12 is an aerosol spray can.

Can 12 is formed to include a canister 13 and a discharge valve 18 coupled to canister 13. Canister 13 is formed to store pressurized fluid therein and discharge valve 18 is formed to release the pressurized fluid from canister 13 when actuated.

Figures 7, 8, 9, 10, 11, 12:
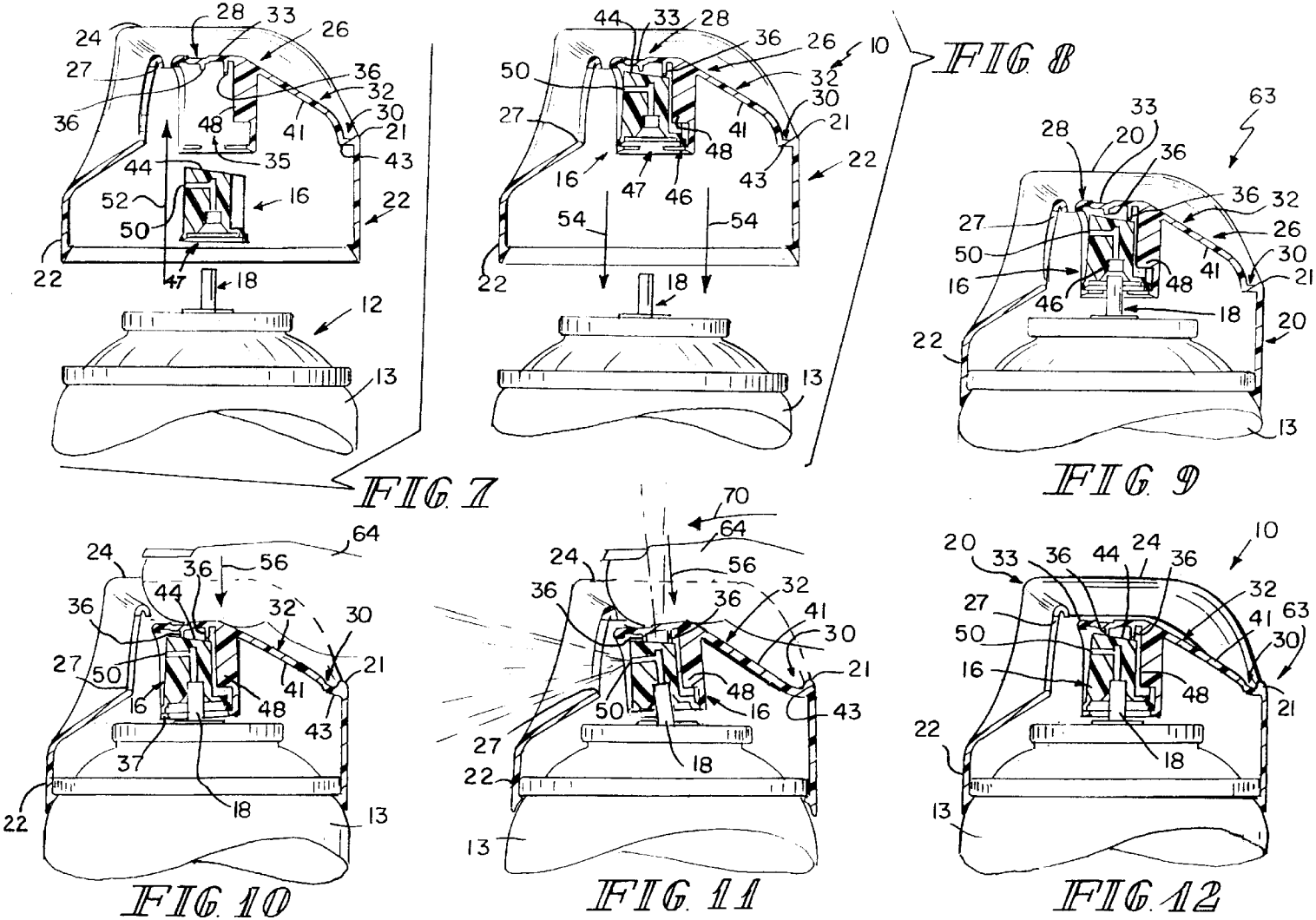
FIG. 7 is a side elevation view of the aerosol spray can of FIG. 4 (with the lid removed) and a cross-sectional view of the cap and push-button showing the push-button ready to be received within the cavity of the button mount coupled to the first end tip of the actuator lever.
FIG. 8 is a side elevation view of the aerosol spray can (with the lid removed) and a cross-sectional view of the lid showing the push-button now received within the cavity of the button mount and also showing the lid (including the cap and push-button) prior to the mounting on the aerosol can.
FIG. 9 is a side elevation view of a presently preferred embodiment of the present invention showing a cross-section of the lid after the lid has been mounted on the can and also showing the actuator lever oriented to lie in a ready-to-use position suspending the push-button so that the push-button above the discharge valve is positioned to lie a spaced-apart distance from the underlying discharge valve without engaging or being coupled to the discharge valve.
FIG. 10 is a side elevation view of the lid of FIG. 9 showing the actuator lever after the actuator lever has been depressed manually by a user's finger, or moved toward the cap, in order to couple the push-button to the underlying discharge valve.
FIG. 11 is a side elevation view similar to FIGS. 9 and 10 showing the actuator lever after it has been depressed further by the user to assume a spray-discharge position wherein the continued downward movement of the push-button toward the can actuates the discharge valve to cause the pressurized contents from within the aerosol spray can to be discharged to the surroundings through the discharge valve, push-button, and aperture of cap.
FIG. 12 is a side elevation view similar to FIGS. 9–11 showing the actuator lever after the push-button and discharge valve have been coupled together by the user as shown in FIG. 10 and showing the push-button remaining coupled to both the actuator lever and discharge valve after initial engagement by the user.

Lid 10 is configured to cause push-button 16 to be suspended above a discharge valve 18 of can 12 when lid 10 is mounted on can 12 as shown in FIG. 7. By suspending or otherwise positioning push-button 16 above discharge valve 18 during cap installation, premature unwanted actuation of discharge valve 18 by engagement of push-button 16 and discharge valve 18 leading to "huffing" is minimized. "Huffing" is the inadvertent discharge of some of the contents within canister 13 of can 12 during cap installation. It is within the scope of the disclosure to define discharge valve 18 as a push-actuated valve or a tilt-activated valve.

Figure 2:
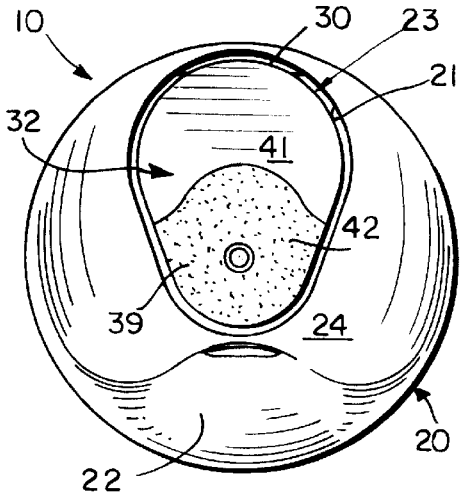
FIG. 2 is a top plan view of the lid shown in FIG. 1 showing the cap including a shell having a contoured portion that is formed to include a tear drop-shaped opening and an actuator lever coupled to the shell and positioned to lie in the tear drop-shaped opening and formed to include a first end having an exterior finger touch pad and a second end having a base that is pivotably coupled to an outer edge of the cap by an integral hinge.
Figure 3:
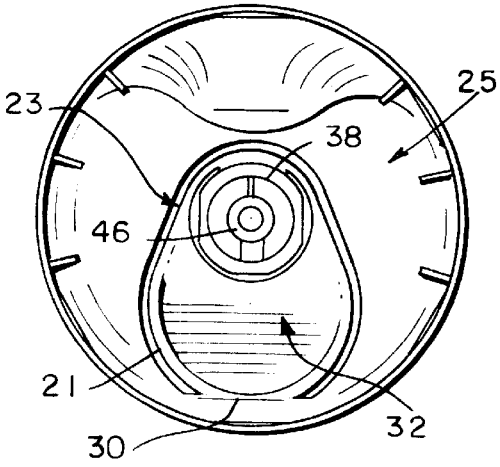
FIG. 3 is a bottom view of the lid shown in FIGS. 1 and 2 showing the first end tip of the actuator lever carrying a button mount forming a cavity receiving the push-button and also showing small retaining tabs extending inwardly from a bottom perimeter edge of the button mount for retaining the push-button within the cavity.
Figure 4:
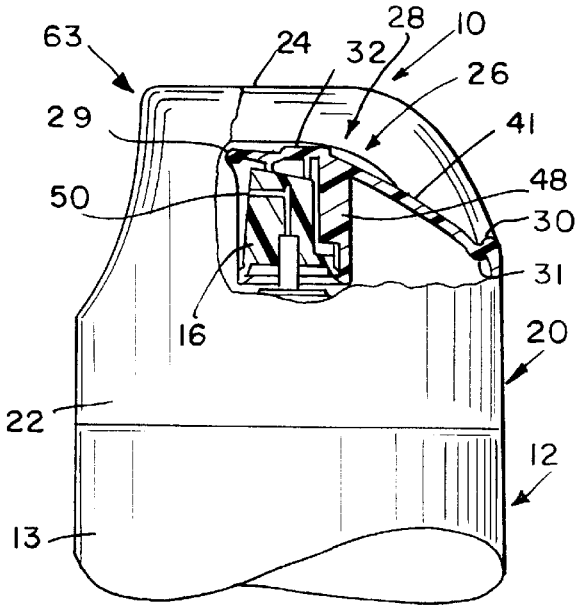
FIG. 4 is a side elevation view of the lid shown in FIGS. 1–3 showing the lid mounted on an underlying aerosol spray can formed to store pressurized fluid and ready for use and also showing (in phantom) the activator lever and push-button received within the button mount of the tip of the actuator lever.

Cap 14 of lid 10 is formed to include an outer shell 20 and a button support 26 coupled to shell 20. Shell 20 is formed to include an outer wall 22 and a top wall 24 coupled to an outer wall 22. Outer wall 22 and top wall 24 cooperate to define a cavity 25. Shell 20 is further formed to include a tear-drop shaped opening 23 forming a rim 21, as shown in FIG. 2, and a discharge aperture 27. Button support 26 is positioned to lie within opening 23 and in spaced-apart relation to rim 21 of opening 23. Button support 26 is coupled to shell 20 for movement between a ready-to-use position as shown in FIG. 9 and a spray discharge position (as shown in FIG. 11). Button support 26 includes a button mount 28 positioned to lie at a first end 29 and an integral hinge 30 coupled to shell 20 and positioned to lie at a second end 31 of button mount 26. Button support 26 further includes a touch pad or actuator lever 32 formed to interconnect button mount 28 and integral hinge 30 and support button mount 28 in the interior region of cap 14.

Figure 5:
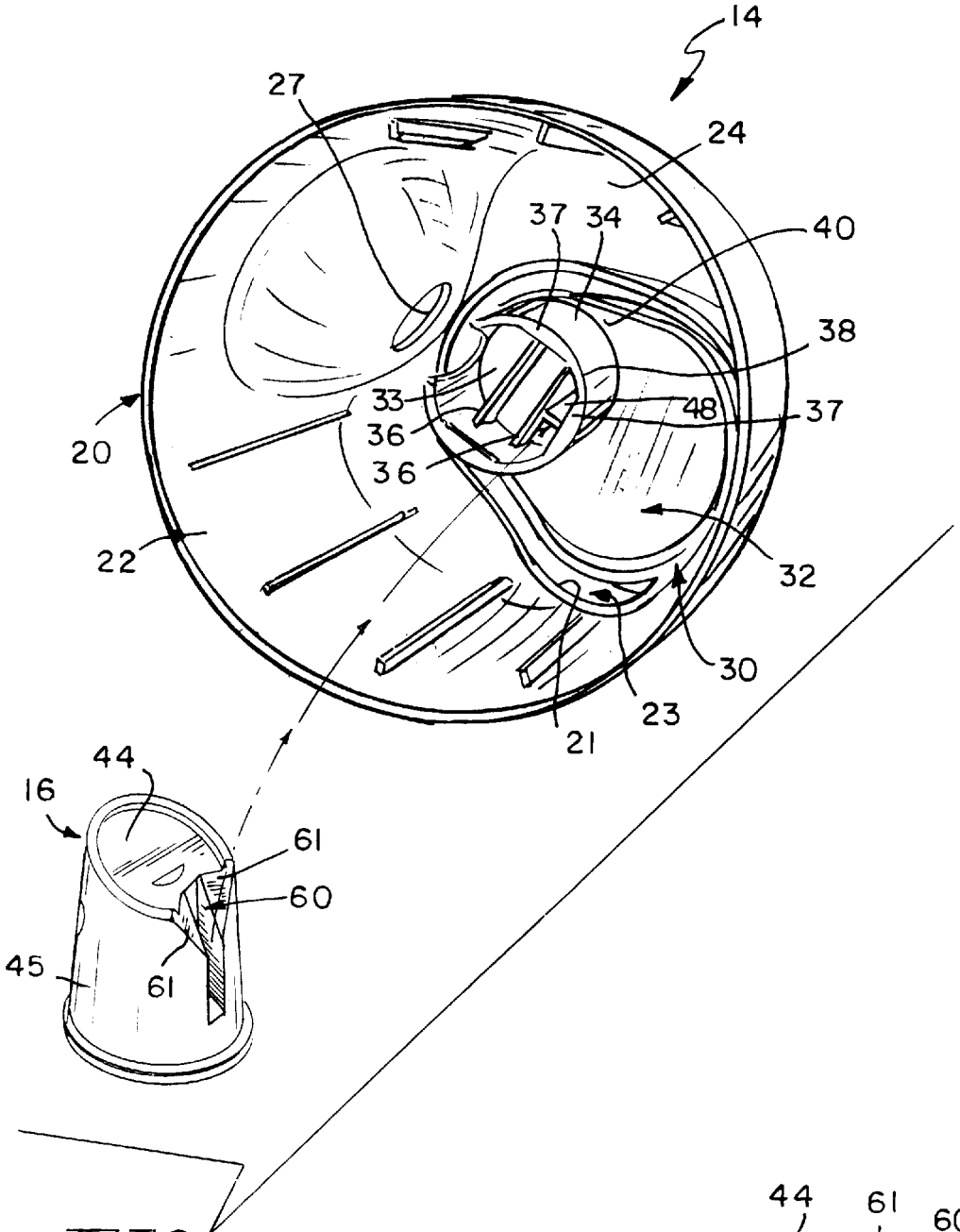
FIG. 5 is an exploded, perspective view of the push-button and the cap showing a notch formed in the push-button and a fin formed in the button mount coupled to the first end tip of the actuator lever such that the fin is received within the notch in order to orient and align a discharge aperture of the push-button properly with a companion discharge aperture formed in a side wall of the cap.
Figure 6:
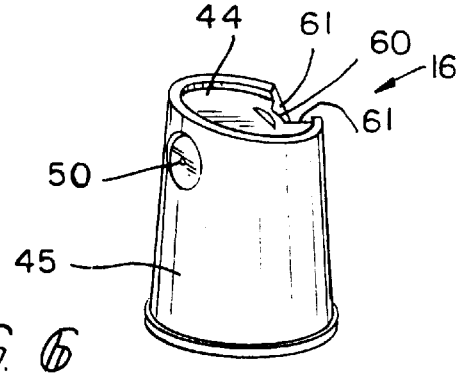
FIG. 6 is a perspective view of the push-button showing the discharge aperture of the push-button of FIG. 5.
Figure 14:
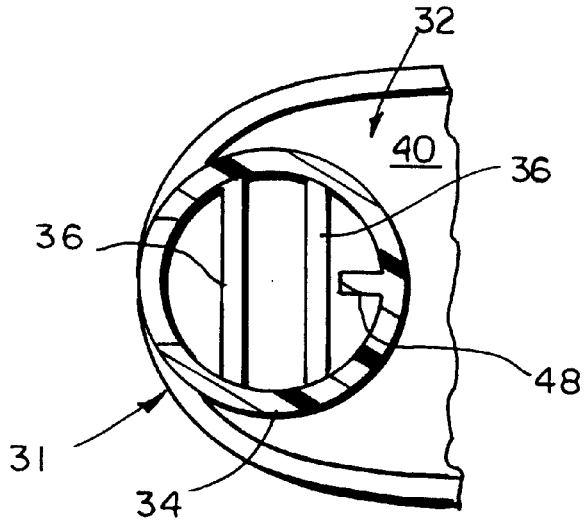
FIG. 14 is a sectional view taken along line 14—14 of FIG. 13 showing the two ribs of the tip extending along an inside surface of the tip of the actuator lever.
Figure 13:
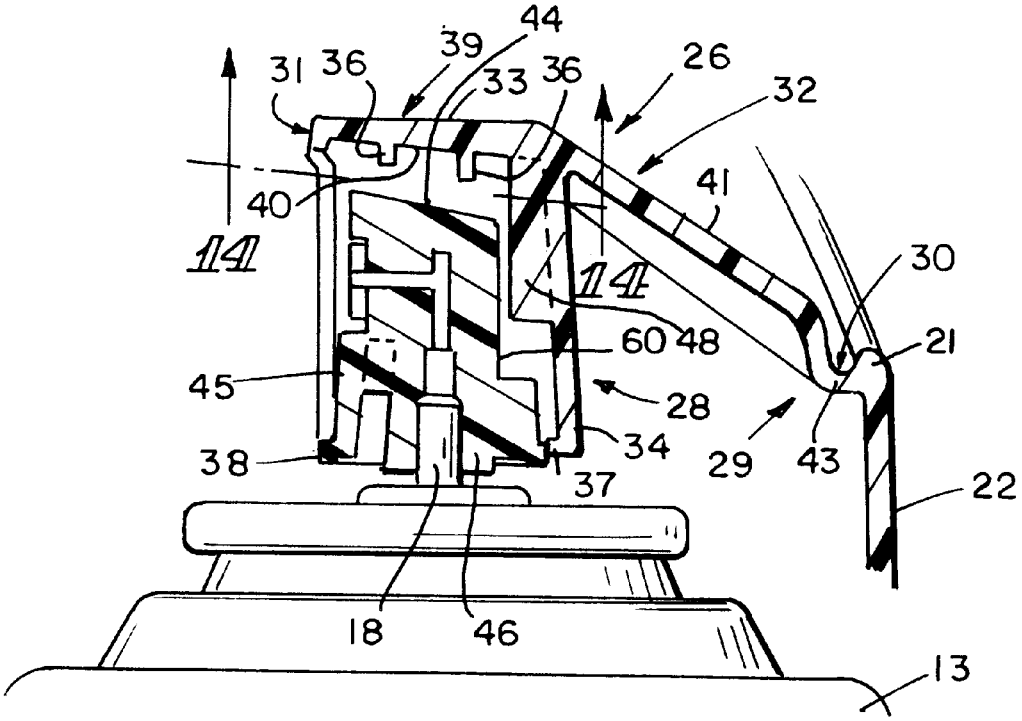
FIG. 13 is an enlarged sectional view similar to FIG. 12 of the preferred embodiment of the present invention showing the push-button coupled to both the button mount and the discharge valve of the can and also showing the button mount formed to include two ribs extending from a top wall of the button mount into the cavity of the button mount so that any extra movement of the push-button relative to the button mount is minimized.

Button mount 28 is formed to include a top wall 33 and a cylindrical wall 34 coupled to and formed to extend downward from top wall 33, as shown in FIG. 5. Top wall 33 is coupled to touch pad 32. Cylindrical wall 3,4 and top wall 33 cooperate to define a cavity 35 for receiving push-button (or button) 16 therein. Button mount 28 is further formed to include two ribs 36 coupled to and positioned to extend downward from top wall 33, as shown in FIGS. 5, 13, and 14. Ribs 36 extend transversely along top wall 24 of button mount 28. Ribs 36 are provided in order to minimize any extra movement of button 16 relative to button mount 28 by decreasing the space between top wall 24 of button mount 28 and top wall 44 of button 16.

Button support 26 is formed to include fin 48 coupled to and positioned to extend into cavity 35 from a cylindrical wall 34. Fin 48 is provided for coupling and positioning of button 16 within button support 26, as will be described below. Button support 26 further includes retaining tabs 37 (or detents) coupled to a bottom perimeter edge 38 of cylindrical wall 34. Tabs 37 are in spaced-apart relation to one another and are positioned to extend into cavity 35. Tabs 37 are provided for retaining button 16 within cavity 35 of button mount 28.

Touch pad 32 is formed to include a flat top 39 having an underside 40, as shown in FIG. 5. Top wall 33 of button mount 28 is appended to underside 40 of touch pad 32 so that cylindrical wall 34 is positioned to extend into cavity 25 of shell 20. Touch pad 32 further includes an inclined portion 41 coupled to flat top 39 at one end and coupled to integral hinge 30 at another end. Touch pad 32 may be molded to include a textured surface 42, as shown, for example, in FIG. 2.

Integral hinge 30 is coupled to inclined portion 41 of touch pad 32 and shell 20 of cap 14. Integral hinge 30 is coupled to shell 20 below rim 21 of opening 23 in order to form a depressed channel 43. Touch pad 32 (with button mount 28) is formed to pivot about integral hinge 30 in order to move button support 26. between the ready-to-use and spray-discharge positions.

Push-button 16 is formed to include a top wall 44, an outer wall 45 extending down from top wall 44, and valve receiver 46 spaced-apart from outer wall 45 and extending down from top wall 44 of button 16. Outer wall 45 and top wall 44, cooperate to define a cavity 47 formed to receive valve receiver 46 therein. Valve receiver 46 is configured to receive discharge valve 18 of can 12 upon movement of button 16 toward can 12. An aperture 50 is formed in outer wall 43 of button 16 to align with discharge aperture 27 formed in outer wall 22 of shell 20. When discharge valve 18 is actuated, as will be described in more detail later, the pressurized fluid from within canister 13 is moved up through discharge valve 18, through valve receiver 45 of button 16, and finally out apertures 50, 52 formed in button 16 and shell 20, respectively.

Push-button 16 further includes a notch 60 formed in outer wall 45 and shown in FIG. 5. Fin. 48 of button mount 28 is formed to be received within notch 60 of button 16 in order to orient button 16 properly within button mount 28. In the proper orientation, aperture 50 of button 16 and aperture 52 of cap 14 are aligned to face the same direction, as shown in FIG. 1. Button 16 further includes two cam surfaces 61 adjacent to notch 60. Cam surfaces 61 are provided to guide fin 48 into notch 60.

To assemble can 12, cap 14, and button 16, in order to form a dispenser apparatus 63, button 16 is first installed in cap 14, as shown by arrow 52 in FIG. 7. As mentioned before, fin 48 is received within notch 60 in order to align button 16 properly within cavity 35 of button mount 28. Button 16 is held in place within cavity 35 by tabs 37 positioned to extend into cavity 35 from cylindrical wall 34. Button 16 coupled to cap 14 formes cap-button sub-assembly, or lid, 10.

To install lid 10 on can 12, cap 14 is first mounted on can 12, as shown by arrows 54 in FIG. 8, and snapped into place about a rim 62 of canister 13, as shown in FIG. 9. In this position after initial mounting of lid 10 on canister 13, push-button 16 has not yet been coupled to discharge valve 18. Here, button support 26 is in the ready-to-use position as shown, for example, in FIG. 9. Touch pad 32 of button support 26 is positioned to suspend button 16 within cavity 35 of button mount 28 a pre-determined distance 54 is spaced-apart relation to discharge valve 18. By suspending button 16 pre-determined distance 54 from discharge valve 18, huffing may be reduced or possibly eliminated during cap installation on a can containing a pressurized fluid therein. When push-button 16 and discharge valve 18 are not coupled together, discharge valve 18 is not caused to actuate during cap installation to thus cause inadvertent discharge of the pressurized fluid within canister 13. In the position shown in FIG. 9, can 12 and lid 10 are fully assembled and in the ready-to-use position for a first time by a user 64.

To operate dispenser apparatus 63, user 64 must first move button support 26, as shown in FIG. 10. Button support 26 is pivotally coupled at integral hinge 30 to outer wall 22, shell 20 of cap 14. Because button support 26 is pivotally coupled to outer wall 22, user 64 is able to depress button support 26 downward in direction 70 as shown by the arrow in FIG. 10, in order to cause button support 26 to pivot about integral hinge 30. By depressing actuator lever 26 downward a first-time, button 16 is urged to engage discharge valve 18 of can 12. Discharge valve 18 is received within valve receiver 45 of button 16.

By depressing button support 26 further, as shown in FIG. 11, button 16 urges discharge valve 18 to actuate. As mentioned before, it is within the scope of the disclosure to include push-actuated and tilt-actuated discharge valves. The pivoting movement of button support 26 in direction 56, as shown in FIG. 11, actuates discharge valve 18 and the pressurized contents of canister 13 are then allowed to move up through discharge valve 18, into receiver 46 of button 16, and finally out aperture 50 of button 16 and aperture 52 of outer wall 22 of cap 14.

Once button 16 has been coupled to discharge valve 18 a first time as shown in FIG. 8, button 16 will remain coupled to discharge valve 18 upon release of button support 26 by user 64, as shown in FIG. 12. In other words, button support 26 remains in the spray-discharge position once lid 10 has been operated a first time by user 64 to spray pressurized fluid of canister 13. Movement of button support 26 by user 64 after button 16 has already been coupled to discharge valve 18 results in discharge valve 18 becoming actuated and thus releasing pressurized contents from within canister 13. Thus, an initial use of lid 10 with aerosol spray can 12 by user 64 requires user 64 to move button support 26 a distance 54 in order to couple button 16 with discharge valve 18. Subsequent uses, however, do not require user 64 to move actuator lever 26 distance 54 since button 16 and discharge valve 18 have already been coupled together and remain coupled to each other after first use. Button 16 and discharge valve 18 must be coupled together in the spray-discharge position for actuation of discharge valve 18 to be made possible.

By providing button 16, which is pre-installed within cavity 35 of button mount 28 prior to mounting lid 10 onto can 12, "huffing" is reduced because button 16 is not coupled with discharge valve 18 prior to use by user 64. Button support 26 does not move to the spray-discharge position, where button 16 is in contact with discharge valve 18, until lid 10 has been operated by user 64 a first time.

Although the invention has been described in detail with reference to certain preferred embodiments, variations and modifications e exist within the scope and spirit of the invention as described and defined in the following claims.

What is claimed is:

1. A dispenser apparatus comprising a can formed to include an interior region to store pressurized fluid therein, a discharge valve coupled to the can to move relative to the can to discharge pressurized fluid from the interior region of the can, a button adapted to engage the discharge valve to move the discharge valve relative to the can to discharge pressurized fluid from the interior region of the can, and a cap including a shell coupled to the can and a button support coupled to the shell and formed to include a hollowed-out chamber having walls and receiving the button therein to support the button in a position in a spaced-apart relation from the discharge valve during coupling of the shell to the can to maintain the button in a position disengaged from the discharge valve until a first engagement of the button and the discharge valve to discharge pressurized fluid from the interior region of the can.

2. The dispenser apparatus of claim 1, wherein the shell is formed to include a side opening arranged to allow pressurized fluid discharged by the discharge valve to pass therethrough and a top opening arranged to lie above the discharge valve and the button support is positioned to lie in the top opening and is coupled to an edge of the shell defining the top opening.

3. The dispenser apparatus of claim 2, wherein the button support includes an actuator lever and an integral hinge arranged to connect the actuator lever to the edge of the shell.

4. The dispenser apparatus of claim 3, wherein the actuator is L-shaped.

5. The dispenser apparatus of claim 2, wherein the shell and button support are made of plastics material and are integral with one another.

6. The dispenser apparatus of claim 2, wherein the button support includes an actuator lever including a perimeter edge and a hinge arranged to couple the actuator lever to the shell for pivotable movement about a pivot axis to cause the perimeter edge to lie in spaced-apart relation to an edge of the shell defining the top opening.

7. A dispenser apparatus comprising a can formed to include an interior region to store pressurized fluid therein, a discharge valve coupled to the can to move relative to the can to discharge pressurized fluid from the interior region of the can, a button adapted to engage the discharge valve to move the discharge valve relative to the can to discharge pressurized fluid from the interior region of the can, and a cap including a shell coupled to the can and a button support coupled to the shell and arranged to support the button in a position in a spaced-apart relation from the discharge valve during coupling of the shell to the can to maintain the button in a position disengaged from the discharge valve until a first engagement of the button and the discharge valve to discharge fluid from the interior region of the can, wherein the shell is formed to include a side opening arranged to allow pressurized fluid discharged by the discharge valve to pass therethrough and a top opening arranged to lie above the discharge valve and the button support is positioned to lie in the top opening and is coupled to an edge of the shell defining the top opening, and wherein the button support includes an actuator lever including a first end positioned to lie in the top opening and a second end coupled to the edge of the shell and a button mount coupled to the first end to lie in an interior region formed in the shell and configured to support the button in spaced-apart relation to the discharge valve.

8. The dispenser apparatus of claim 7, wherein the first end of the actuator lever includes an outer surface defining a finger touch pad and an opposite inner surface facing into the interior region of the shell and the button mount includes a cylindrical wall extending downwardly from the inner surface to form a cavity lying in the interior region of the shell and receiving the button therein.

9. The dispenser apparatus of claim 7, wherein the button mount includes a cylindrical wall defining a cavity receiving the button therein and a fin extending from the cylindrical wall into the cavity and the button is formed to include a notch receiving the fin therein.

10. The dispenser apparatus of claim 7, wherein the button mount includes a cylindrical wall defining a cavity receiving the button therein and a fin extending from the cylindrical wall into the cavity and the button is formed to include a notch receiving the fin therein and a can surface positioned to lie adjacent to the notch and arranged to guide the fin into the notch during movement of the button relative to the button mount in the cavity formed in the button mount.

11. A dispenser apparatus comprising a can formed to include an interior region to store pressurized fluid therein, a discharge valve coupled to the can to move relative to the can to discharge pressurized fluid from the interior region of the can, a button adapted to engage the discharge valve to move the discharge valve relative to the can to discharge pressurized fluid from the interior region of the can, and a cap including a shell coupled to the can and a button support coupled to the shell and arranged to support the button in a position in a spaced-apart relation from the discharge valve during coupling of the shell to the can to maintain the button in a position disengaged from the discharge valve until a first engagement of the button and the discharge valve to discharge pressurized fluid from the interior region of the can, wherein the shell is formed to include a side opening arranged to allow pressurized fluid discharged by the discharge valve to pass therethrough and a top opening arranged to lie above the discharge valve and the button support is positioned to lie in the top opening and is coupled to an edge of the shell defining the top opening, the button support includes an actuator lever including a perimeter edge and a hinge arranged to couple the actuator lever to the shell for pivotable movement about a pivot axis to cause the perimeter edge to lie in spaced-apart relation to an edge of the shell defining the top opening, the actuator lever includes a top side defining a touch pad positioned to lie in spaced-apart relation to the hinge and an underside facing into an interior region of the shell toward the discharge valve therein, and the button support further includes a button mount coupled to the underside and configured to support the button in the interior region of the shell.

12. A dispenser apparatus comprising a can formed to include an interior region to store pressurized fluid therein, a discharge valve coupled to the can and configured to discharge pressurized fluid from the interior region of the can, and a cap coupled to the can, the cap including a shell arranged to cooperate with the can to define a space therebetween receiving the discharge valve therein, a button adapted to be coupled to the discharge valve and to be moved relative to the can to actuate the discharge valve to discharge pressurized fluid from the interior region of the can, a button mount coupled to the button, and means for supporting the button mount above the can to position the button in a position above and in spaced-apart relation to the discharge valve so that movement of the button mount toward the can engages the button to the discharge valve to actuate the discharge valve, the support means including a lever coupled to the shell.

13. The dispenser apparatus of claim 12, wherein the button mount is formed to include a top wall and a cylindrical wall extending downwardly from the top wall to form a cavity receiving the button therein.

14. The dispenser apparatus of claim 13, wherein the button mount further includes a fin extending from the cylindrical wall into the cavity and the button is formed to include a notch receiving the fin therein.

15. The dispenser apparatus of claim 14, wherein the button is further formed to include at least one cam surface adjacent to the notch in order to guide the fin of the button mount into the notch.

16. The dispenser apparatus of claim 13, wherein the button mount is further formed to include at least one rib coupled to the top wall and extending into the cavity.

17. The dispenser apparatus of claim 12, wherein the shell is formed to include an aperture and the lever is positioned to lie within the aperture, and the lever is coupled to the shell by an integral hinge at a first end and coupled to the button mount at a second end.

18. The dispenser apparatus of claim 17, wherein the aperture of the shell forms a rim and the integral hinge is formed to include a channel coupled to the shell and positioned to lie below the rim of the shell.

19. A dispenser apparatus comprising a canister including a can formed to store pressurized fluid therein and a discharge valve coupled to the can and formed to release the contents of the can when actuated, a cap coupled to the canister, the cap formed to include a shell, a button mount, and a lever arranged to interconnect the shell and the button mount, the button mount having a top wall, a cylindrical wall arranged to extend from the top wall to form a cavity in the button mount and cooperate with the top wall, a fin coupled to the cylindrical wall and arranged to extend into the cavity, and a button coupled to the cap and positioned to lie within the cavity of the button mount, the button being formed to include a notch for receiving the fin of the button mount therein and an aperture for receiving the discharge valve therein, and wherein the lever is positioned to support the button in a position such that movement of the lever toward the can couples the button to the discharge valve of the canister.

20. The dispenser apparatus of claim 19, wherein the button is further formed to include two cam surfaces each adjacent to the notch, the cam surfaces are provided in order to guide the fin of the button mount into the notch.

21. The dispenser apparatus of claim 19, wherein the cylindrical wall of the button mount further includes a first end coupled to the top wall, a second end, and detents coupled to the second end and formed to extend into the cavity of the button mount, and the detents are spaced-apart from one another and formed to hold the button within the cavity of the button mount.

22. The dispenser apparatus of claim 19, wherein the button is formed to include a body having a top surface, an outer wall, and a bottom edge thus forming a cavity therein and the button further includes a valve receiver positioned to lie within the cavity of the button and formed to receive the discharge valve therein, and wherein the notch of the button is formed in the outer wall and extends from the top surface of the button to a pre-determined distance spaced-apart from the bottom edge of the button.

23. The dispenser apparatus of claim 19, wherein the button and cap, when coupled to each other, form a cap-button assembly and wherein the cap-button assembly is coupled to a canister having either one of a tilt-actuated and push-actuated discharge valve.

24. A dispenser apparatus comprising a canister including a can formed to store pressurized fluid therein and a discharge valve coupled to the can and formed to release the pressurized fluid when actuated, a cap coupled to the canister and formed to include a shell having a generally cylindrical wall forming a bottom edge and a cavity therein, the shell further forming an aperture defined by a rim, and the cap further including a button support coupled to the shell and positioned to lie within the aperture of the shell and in spaced-apart relation to the rim of the aperture, and a button coupled to the button support of the cap and positioned to lie a predetermined distance from the can and in spaced-apart relation to the discharge valve so that movement of the button support toward the can couples the button to the discharge valve without separation of the button from the button support.

25. A dispenser apparatus comprising a canister including a can formed to store pressurized fluid therein and a discharge valve coupled to the can and formed to release the pressurized fluid when actuated, a cap coupled to the canister and formed to include a shell having a generally cylindrical wall forming a bottom edge and a cavity therein the shell further forming an aperture defined by a rim, and the cap further including a button support coupled to the shell and positioned to lie within the aperture of the shell and in spaced-apart relation to the rim of the aperture, a button coupled to the button support of the cap and positioned to lie a predetermined distance from the can and in spaced-apart relation to the discharge valve so that movement of the button support toward the can couples the button to the discharge valve, wherein the button support is formed to include a touch pad, a button mount coupled to an underside portion of the touch pad, and an integral hinge formed to interconnect the touch pad and the shell.

26. The apparatus of claim 25, wherein the button mount is formed to include a top wall coupled to the touch pad and a cylindrical wall formed to extend downward from the top wall in order to provide a cavity formed to receive the button and a generally vertical fin appended to an inner surface of the cylindrical wall, and also wherein the button is formed to include a generally vertical notch and the fin of the button mount is formed to be received within the notch of the button.

27. The apparatus of claim 26, wherein the button mount is further formed to at least one rib coupled to the top wall and formed to extend into the cavity formed by the cylindrical wall.

28. The apparatus of claim 25, wherein the touch pad is formed to include a flat top having an underside such that the button mount is appended to the underside and an inclined portion formed to interconnect the flat top and the integral hinge.

29. The apparatus of claim 25, wherein the shell is formed to include an aperture for receiving the button support, the aperture forming an outer rim and wherein the integral hinge is formed to include a depressed channel positioned to lie below the outer rim and the inclined portion of the touch pad is coupled to the depressed channel of the integral hinge.

30. A method for installing a button on an aerosol can so that the button is positioned to lie above the can, the method comprising the steps of providing an aerosol can including a canister formed to store pressurized fluid therein and a discharge valve formed to release the pressurized fluid when actuated, a cap formed to include a shell, a button mount formed to a include a cavity defined by a top wall and a cylindrical wall coupled to a top wall, and a lever pad formed to interconnect the shell and the button mount, and the can further including a button formed to be received within the cavity of the button mount, mounting the button within the cavity of the button mount so that a fin formed in the button mount and positioned to extend from the cylindrical wall into the cavity is received within a notch formed in the button, and coupling the shell of the cap to the aerosol can such that the button is spaced-apart a pre-determined distance from a top surface of the can and in a spaced-apart relation to the discharge valve of the can so that movement of the lever pad toward the can couples the button to the discharge valve thereby enabling the discharge valve to be actuated.

31. A method of discharging product from a pressurized container, the method comprising the steps of providing an aerosol can having a canister formed to store pressurized fluid and discharge valve coupled to the canister and formed to release the pressurized fluid when actuated and further providing a cap formed to include a shell, a button mount formed to a include a cavity defined by a top wall and a cylindrical wall coupled to and extending downwardly from the top wall, and a lever pad formed to interconnect the shell and the button mount, and further providing a button received within the cavity of the button mount, moving the lever toward the can, and coupling the button with the discharge valve in order to actuate the discharge valve thereby releasing the pressurized fluid within the can.

32. A method of assembling a dispenser apparatus, the method comprising the steps of providing a canister including a can formed to hold pressurized fluid therein and a discharge valve formed to release the pressurized fluid from within the can when actuated, a cap including a shell having a first rim defining a lower edge of the shell and a second rim defining an aperture formed in the shell, the cap further including a button support coupled to the shell and positioned to lie within the aperture formed in the shell, and further providing a button, coupling the button to the button support of the cap to form a cap-button assembly, and mounting the cap-button assembly onto the canister such that the button is positioned to lie in a pre-determined position relative to the discharge valve such that a first generally downward or tilting motion of the button support causes the button to actuate and couple with the discharge valve without separating the button from the button support.

33. A dispenser apparatus comprising a can formed to include an interior region to store pressurized fluid therein, a discharge valve coupled to the can to move relative to the can to discharge pressurized fluid from the interior region of the can, a button adapted to engage the discharge valve to move the discharge valve relative to the can to discharge pressurized fluid from the interior region of the can, and a cap including a shell coupled to the can and a button support coupled to the shell and arranged to support the button in a position in a spaced-apart relation from the discharge valve during coupling of the shell to the can to maintain the button in a position disengaged from the discharge valve until a first engagement of the button and the discharge valve to discharge pressurized fluid from the interior region of the can; wherein, the shell is formed to include a side opening arranged to allow pressurized fluid discharged by the discharge valve to pass therethrough and a top opening arranged to lie above the discharge valve and the button support is positioned to lie in the top opening and is coupled to an edge of the shell defining the top opening; and, the button support includes an actuator lever including a first end positioned to lie in the top opening and a second end coupled to the edge of the shell and a button mount coupled to the first end to lie in an interior region formed in the shell and configured to support the button in spaced-apart relation to the discharge valve; and, the first end of the actuator lever includes an outer surface defining a finger touch pad and an opposite inner surface facing into the interior region of the shell and the button mount includes a cylindrical wall extending downwardly from the inner surface to form a cavity lying in the interior region of the shell and receiving the button therein.

* * * * *